US011203508B2

(12) United States Patent
Christe

(10) Patent No.: US 11,203,508 B2
(45) Date of Patent: Dec. 21, 2021

(54) METHOD AND DEVICE FOR SWIVELING A BOBBIN IN A WINDING DEVICE

(71) Applicant: SSM Schärer Schweiter Mettler AG, Horgen (CH)

(72) Inventor: Marcel Christe, Rüti (CH)

(73) Assignee: SSM Schärer Schweiter Mettler AG, Horgen (CH)

( * ) Notice: Subject to any disclaimer, the term of this patent is extended or adjusted under 35 U.S.C. 154(b) by 278 days.

(21) Appl. No.: 16/574,190

(22) Filed: Sep. 18, 2019

(65) Prior Publication Data

US 2020/0087821 A1 Mar. 19, 2020

(30) Foreign Application Priority Data

Sep. 18, 2018 (CH) ..... 01112/18

(51) Int. Cl.
*B65H 54/52* (2006.01)
*B65H 63/036* (2006.01)

(52) U.S. Cl.
CPC ..... *B65H 63/0364* (2013.01); *B65H 54/52* (2013.01); *B65H 2701/31* (2013.01)

(58) Field of Classification Search
CPC ..... B65H 63/0364; B65H 54/52
See application file for complete search history.

(56) References Cited

U.S. PATENT DOCUMENTS 3,241,778 A 3/1966 Bourgeas

FOREIGN PATENT DOCUMENTS

| | | |
|---|---|---|
| CN | 207 375 497 U | 5/2018 |
| DE | 102 06 288 A1 | 8/2003 |
| EP | 0 351 672 A1 | 1/1990 |
| EP | 1 820 764 A2 | 8/2007 |

OTHER PUBLICATIONS

CH Search Report, dated Dec. 4, 2018.

*Primary Examiner* — William E Dondero
(74) *Attorney, Agent, or Firm* — Dority & Manning, P.A.

(57) ABSTRACT

A winding device and associated method for swiveling a bobbin in the winding device during an interruption of a winding operation are provided, wherein the bobbin rests on a backing roller and is formed on a bobbin tube onto which a thread is wound. The bobbin tube is rotatably held between holders on two retaining arms mounted on a common swivel arm having a swivel axis. With force measurement unit, one of intrinsic weight of the bobbin or a force effect that acts on the retaining arms due to contact of the bobbin with the backing roller is measured. A manual force is transmitted into at least one of the retaining arms in a force direction that is determined by evaluating the force measurement unit. With a drive that is operably configured with the swivel arm, the swivel arm is swiveled in the force direction.

9 Claims, 2 Drawing Sheets

METHOD AND DEVICE FOR SWIVELING A BOBBIN IN A WINDING DEVICE

FIELD OF THE INVENTION

The present invention relates to a method for swiveling a bobbin in a winding device during an interruption in the winding operation, and the associated winding device. The bobbin rests on a backing roller and is formed from a bobbin tube onto which a thread is wound. The bobbin tube is rotatably held between two retaining arms via a holder, and the two retaining arms are mounted on a shared swivel arm having a swivel axis.

BACKGROUND

These types of winding devices are used in textile machines of various designs, for example final spinning machines or winding machines. The bobbin or the bobbin tube is rotatably held between two retaining arms. The two retaining arms in turn are mounted in a shared swivel arm having a swivel axis. At the start of a winding operation, the bobbin tube rests on a backing roller and is set in rotation via a drive, thereby winding a thread or a yarn supplied between the backing roller and the bobbin tube onto the bobbin tube and forming a bobbin. Various types of bobbin tubes are used having a cylindrical or conical shape and made of various materials, such as plastic or paper. The bobbin tubes may be designed with or without side flanges. During the winding, the thread is moved back and forth along a longitudinal axis of the bobbin tube by a traverse unit, thus forming various structures and shapes of windings. The drive of the bobbin tube is provided directly via a motor that sets at least one of the tube holders in rotation, or is provided indirectly via a friction roller situated in parallel to the bobbin tube. The friction roller may be designed as a so-called grooved drum. The grooved drum is provided with a yarn guide, which is guided in slots by the rotation of the grooved drum in such a way that the thread is moved back and forth. For a direct drive of the bobbin tube, the traversing of the thread is to be provided by a separate laying unit, and the bobbin tube is supported via a backing roller. The thread is clamped between the backing roller and the bobbin tube, or the thread that is already on the bobbin tube, and is thus laid down on the bobbin tube.

The diameter of the bobbin that results from the thread being wound onto the bobbin tube continuously increases due to the winding operation. As a result, the distance between the backing roller and the longitudinal axis of the bobbin tube increases, which is compensated for by a movement of the retaining arms about a swivel axis of the swivel arm. However, the intrinsic weight of the bobbin resting on the backing roller or friction roller also increases due to the winding operation. The pressing force acting on a surface of the bobbin therefore increases. To keep this pressing force from becoming too great, it is known from the prior art, for example EP 1 820 764 A2, to use counterweights that hold the pressing forces to an approximately constant level. After the winding operation is completed, the finished bobbin must be lifted from the backing roller or the friction roller in order to allow removal of the bobbin from the retaining arms and insertion of a new bobbin tube. This lifting of the bobbin is brought about by a swivel operation of the swivel arm. According to the prior art, this swivel operation is carried out manually via a lever that is mounted on at least one of the retaining arms. To assist with the manual lifting, devices are known in which the manual effort may be reduced by using counterweights.

A disadvantage of the known designs and methods for bobbin removal is that a high level of manual force must be applied, or complicated devices for lifting the bobbin are necessary. It is noted that a full bobbin to be lifted may have an intrinsic weight of up to 25 kg.

SUMMARY OF THE INVENTION

An object of the present invention, therefore, is to propose a method and a device for bobbin removal which allow the bobbin to be swiveled relative to the backing roller or friction roller without the need for great manual effort. Additional objects and advantages of the invention will be set forth in part in the following description, or may be obvious from the description, or may be learned through practice of the invention.

The objects are achieved by a method and a device having the features described and claimed herein.

A method is proposed for swiveling a bobbin in a winding device during an interruption in a winding operation, wherein the bobbin rests on a backing roller and is formed on a bobbin tube onto which a thread is wound, and the bobbin tube is rotatably held in a bobbin frame between two retaining arms via a holder in each case, and the two retaining arms are mounted on a shared swivel arm having a swivel axis. A force effect that acts on at least one retaining arm due to contact of the bobbin with the backing roller or the intrinsic weight of the bobbin is measured by a force measurement unit. A force is introduced into this retaining arm by a manual transmission of force, wherein a force direction of the manually introduced force is determined by evaluating the force measurement, and by means of a drive the swivel arm is swiveled corresponding to the force direction.

Current machines having a winding device are equipped with controllers that include monitoring of drive positions. Based on the position of the drive and the measured force effect, the particular position of the bobbin frame with the bobbin situated therein is known to the controller at all times. If the winding operation is now interrupted due to a malfunction, or because the bobbin is full and must be exchanged, and a force is manually applied to one of the retaining arms and thus to the bobbin frame, this is detected by the controller due to the change in the magnitude of force from the force measurement. If the bobbin is in a position in which it rests on the backing roller and the measured force changes due to the manual action, based on the change in force the controller determines the direction of the force effect and triggers a swivel motion of the bobbin frame in the determined direction of the force effect. When the operator manually acts on the bobbin frame by lifting it, just a few grams of lifting force are sufficient to induce the controller to lift the bobbin frame, and thus the bobbin, from the backing roller via a swivel motion. Since the controller also knows the intrinsic weight of the bobbin from the preceding winding operation, the swivel motion may be maintained as long as the manual application of force cancels out a slight portion of the intrinsic weight. As soon as the manual application of force is discontinued, this induces the controller to stop the swivel motion, as the result of which the bobbin frame and thus the bobbin are secured in the attained position. As a prerequisite, the drive must be appropriately designed for the swivel motion. However, such designs are known from the prior art, for example pneumatic drives or electric drives that are equipped with corresponding brakes or self-locking gears. After the full bobbin is removed and an empty bobbin tube is inserted, a slight manual application of force in the appropriate direction triggers a swivel motion of the bobbin frame against the backing roller.

The swivel arm is advantageously swiveled for as long as the manual transmission of force continues. In this way, any given position of the bobbin may be achieved by simply lightly pressing in the desired movement direction. The controller preferably automatically brings the bobbin into an operating position during a swivel motion against the backing roller. As a result of the bobbin or the bobbin tube achieving contact with the backing roller during a swivel motion against the backing roller, the direction of the action of force is rotated due to the contact, and the controller recognizes that the operating position has been reached. It is thus possible for only a brief manual application of force to initiate a swivel motion against the backing roller, since the force causes the operating position of the winding device to be automatically assumed.

A continuation of the winding operation is advantageously enabled when the bobbin rests on the backing roller. As long as the bobbin or the bobbin tube does not rest on the backing roller, the controller blocks the winding operation from starting. The aim is to prevent a thread from being wound in an uncontrolled manner.

In addition, a winding device for winding a thread onto a bobbin tube is proposed, having a swivel arm with a swivel axis, two retaining arms that are nonrotatably mounted on the swivel arm and extend at a distance in parallel to one another, each retaining arm having a holder for the bobbin tube rotatably situated on the end of the retaining arm facing away from the swivel arm, and having a backing roller for contacting the bobbin tube. A drive for moving the swivel arm about the swivel axis is provided, and at least one of the retaining arms has a force measurement unit for measuring a force that acts on the retaining arm. In addition, at least one of the retaining arms has a defined location for the manual transmission of force. A controller is provided, wherein the controller determines a direction of movement of the swivel arm about the swivel axis based on a force direction of the manual transmission of force.

A thread is wound onto the bobbin tube and a bobbin is formed by means of a traverse unit, as the result of which the diameter of the bobbin increases. Due to the contact of the bobbin with the backing roller, the bobbin frame is automatically swiveled away from the backing roller about the swivel axis. During the winding operation, the thread is clamped between the bobbin tube, or the thread that is already wound onto the bobbin tube, and the backing roller, resulting in a tight winding on the bobbin tube. An applied clamping force continuously increases during a winding operation due to the intrinsic weight of the bobbin, which becomes increasingly larger. A bending moment results in the retaining arms as a response to the clamping force F and the lifting of the bobbin frame. The bending moment is measured by a force measurement unit. This measurement is used for the invention. An additional action of force that is manually introduced into the retaining arm signals to the controller that the swivel arm, and thus the bobbin frame and the bobbin, are to be swiveled. For the manual transmission of force, a defined location is provided at one of the retaining arms, preferably on the same retaining arm as the force measurement unit. This defined location may be provided in the form of a marking, a lever, or an ergonomically shaped depression. The advantage of a defined location instead of a button or some other control element is that no cabling or other type of signal link need be provided between the input site for the command and the controller to move the bobbin frame. Via the force measurement unit, the controller determines the particular direction in which the manual transmission of force takes place, and on this basis determines the direction for the swivel motion.

At least one of the retaining arms advantageously has a two-part design, and the two parts are connected via the force measurement unit. The force measurement unit may be designed as a load cell, for example. Various designs of so-called force sensors may be used in load cells. For example, the use of force sensors is known in which the force acts on an elastic spring element and deforms it. The deformation of the spring element is converted into the change in a voltage via strain gauges whose electrical resistance changes with the strain. The voltage, and thus the change in the strain, is recorded by a measuring amplifier. The voltage may be converted into a measured force value, based on the elastic properties of the spring element. Bending beams, annular torsion springs, or other designs may be used as a spring element. In another design of load cells, piezoceramic elements are used in which microscopic dipoles form inside the unit cells of the piezocrystal due to the targeted deformation of a piezoelectric material. Summation over the associated electrical field in all the unit cells of the crystal results in a macroscopically measurable voltage that may be converted into a measured force value. Load cells are known from the prior art, and are widely used nowadays in force and weight measurement. The force measurement unit is preferably a bending beam load cell. This has the advantage of a robust, simple design. Each of the two parts of the retaining arm is fastened to the bending beam load cell, as the result of which the bending beam load cell becomes a part of the retaining arm.

The drive for moving the swivel arm about the swivel axis is preferably an electric motor. The electric motor is preferably provided with a self-locking gear. This has the advantage that a swiveled-up bobbin frame does not lower without actuation of the drive, i.e., remains in position even in a de-energized state of the drive.

The defined location is advantageously designed as an extension of the two-part retaining arm. The extension occurs at the location of the levers, known from the prior art, provided for lifting the bobbins. In addition, it is possible to appropriately mark the extension and provide it with an ergonomic design.

BRIEF DESCRIPTION OF THE DRAWINGS

Further advantages of the invention are described in the following exemplary embodiments, as shown in the following figures.

DETAILED DESCRIPTION

Figure 1:
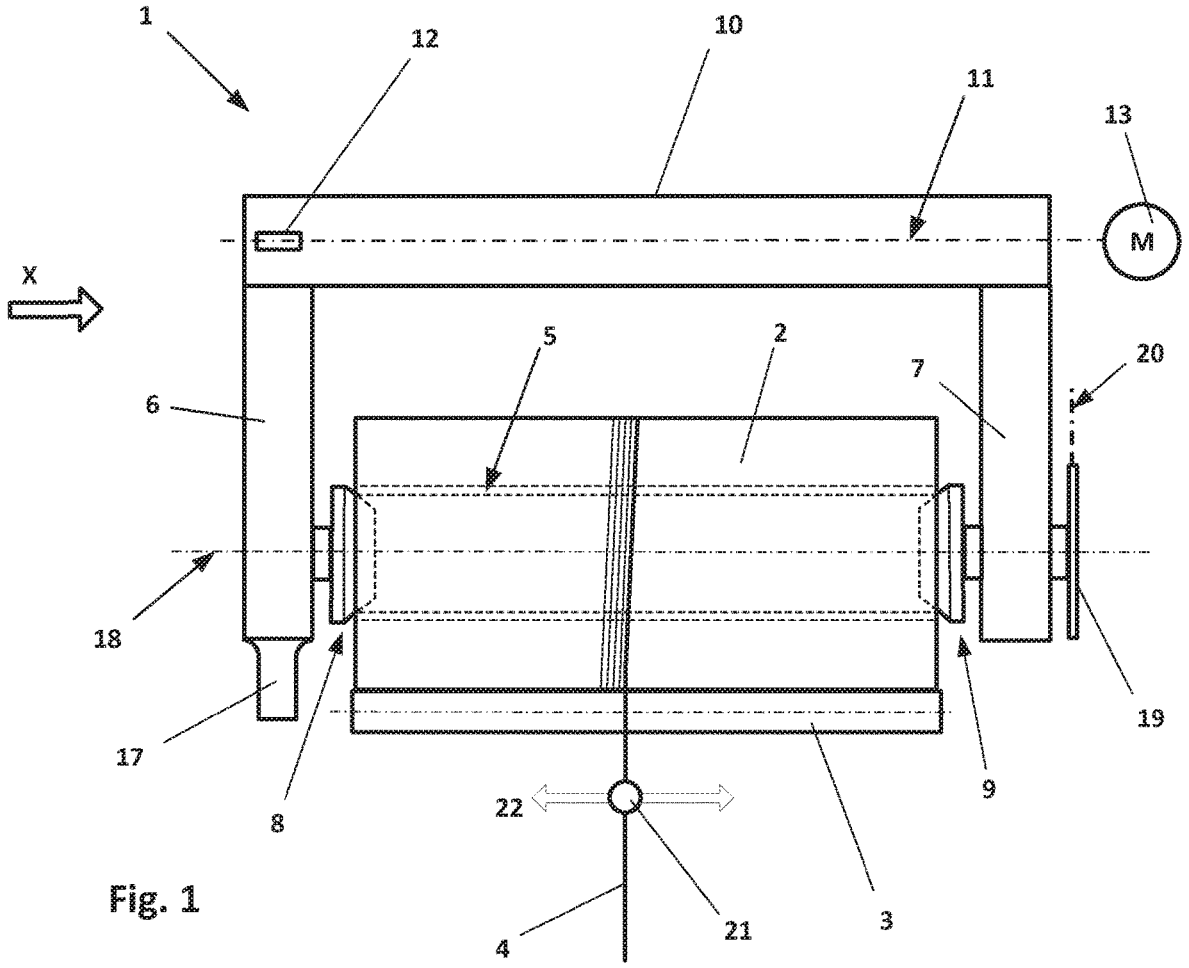
FIG. 1 shows a schematic top view of a first embodiment of a winding device.

Reference will now be made to embodiments of the invention, one or more examples of which are shown in the drawings. Each embodiment is provided by way of explanation of the invention, and not as a limitation of the invention. For example features illustrated or described as part of one embodiment can be combined with another embodiment to yield still another embodiment. It is intended that the present invention include these and other modifications and variations to the embodiments described herein.

Figure 2:
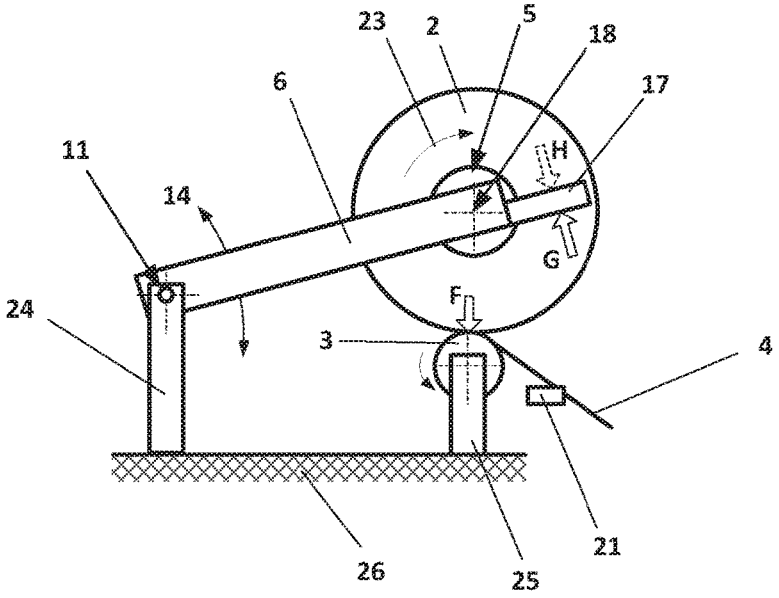
FIG. 2 shows a schematic side view of the winding device in direction X according to FIG. 1.

FIG. 1 shows a schematic top view, and FIG. 2 shows a schematic side view of a first embodiment of a winding device in direction X in FIG. 1. The winding device includes a bobbin frame 1 made up of a swivel arm 10 having a swivel axis 11, and a first retaining arm 6 and a second retaining arm 7. The retaining arms 6 and 7 are nonrotatably fastened at opposite ends of the swivel arm 10. A swivel motion 14 of the swivel arm 10 thus causes the retaining arms 6 and 7 together with the swivel arm to be swiveled about the swivel axis 11. A drive 13 is provided for the swivel motion 14 of the bobbin frame 1. In the design shown, the drive 13 is depicted as an electric motor. The swivel arm 10 is held in a machine frame 26 via corresponding stanchions 24. In addition, holders 8 and 9 for a bobbin tube 5 are rotatably mounted opposite from one another at the end of the respective retaining arms 6 and 7 opposite from the swivel arm 10 via a respective bearing bolt. The first holder 8 and the second holder 9 are situated in a shared bobbin axis 18. A bobbin tube 5 is clamped between the holders 8 and 9. One of the two holders 8 or 9, for example the holder 8, is held in the retaining arm 6 so that it is displaceable in the direction of the bobbin axis 18. In this way, a bobbin tube 5 may be inserted between the holders 8 and 9, and the holder 8 may subsequently be pressed against the holder 9, thus clamping the bobbin tube 5. In the embodiment shown, the holder 9 is connected to a drive wheel 19 in the bobbin axis 18. The drive wheel 19 is set in rotation by a drive element 20, for example a chain drive, which results in rotation of the bobbin tube 5 in the rotational direction 23 due to the connection to the holder 9.

Situated in parallel to the bobbin axis 18 of the bobbin tube 5 is a backing roller 3 on which the bobbin tube 5 comes to rest due to the swivel motion 14 of the swivel arm 10 about the swivel axis 11. The backing roller 3 is rotatably fastened in the machine frame 26 via corresponding mountings 25. As a result of the rotation of the bobbin tube 5 in a corresponding rotational direction 23, a thread 4 that is laid on the bobbin tube 5 is wound onto the bobbin tube 5, and a bobbin 2 is formed. During this winding operation, a traverse unit 21 moves the thread 4 back and forth along the bobbin axis 18 of the bobbin tube 5. Various types of windings or bobbins 2 may be produced on the bobbin tube 5 by means of this movement direction 22 of the traverse unit 21. The bobbin 2 increases in diameter due to the formation of a winding on the bobbin tube 5, so that the contact with the backing roller 3 causes the bobbin frame 1 to be swiveled away from the backing roller 3 about the swivel axis 11. During the winding operation, the thread 4 is clamped between the bobbin tube 5, or the thread 4 that is already wound onto the bobbin tube 5, and the backing roller 3, resulting in a tight winding on the bobbin tube 5. A clamping force F hereby applied continuously increases during a winding operation due to the intrinsic weight of the bobbin 2, which becomes increasingly larger. To be able to ensure a constant clamping force F, the bobbin frame 1 is lifted from the backing roller 3 about the swivel axis 11 with a swivel motion 14, by the drive 13. However, this lifting is carried out only enough for a predetermined clamping force F to remain between the bobbin 2 and the backing roller 3. A bending moment results in the retaining arms 8 and 9 as a response to the clamping force F and the lifting of the bobbin frame 1 by the drive 13. The bending moment is measured by a force measurement unit 12, which may be provided in the fastening of the retaining arm 6 to the swivel arm 10.

A defined location 17 for the manual transmission of force into the retaining arm 6 is provided on the retaining arm 6. The defined location 17 is designed as an extension of the retaining arm 6. The operator can now easily press against this extension (just a few 100 grams is sufficient) in order to apply a force G or H to the extension, depending on the intended movement direction. The force G is manually applied when the bobbin 2 is to be moved away from the backing roller 3, and the force H is manually applied when the bobbin 2 or the bobbin tube 5 is to be moved toward the backing roller 3. This transmission of force is determined by the force measurement unit, whereupon the controller, via the drive 13, moves the swivel arm 10, and thus the bobbin frame 1 and the bobbin 2, in the appropriate direction via a swivel motion 14.

Figure 3:
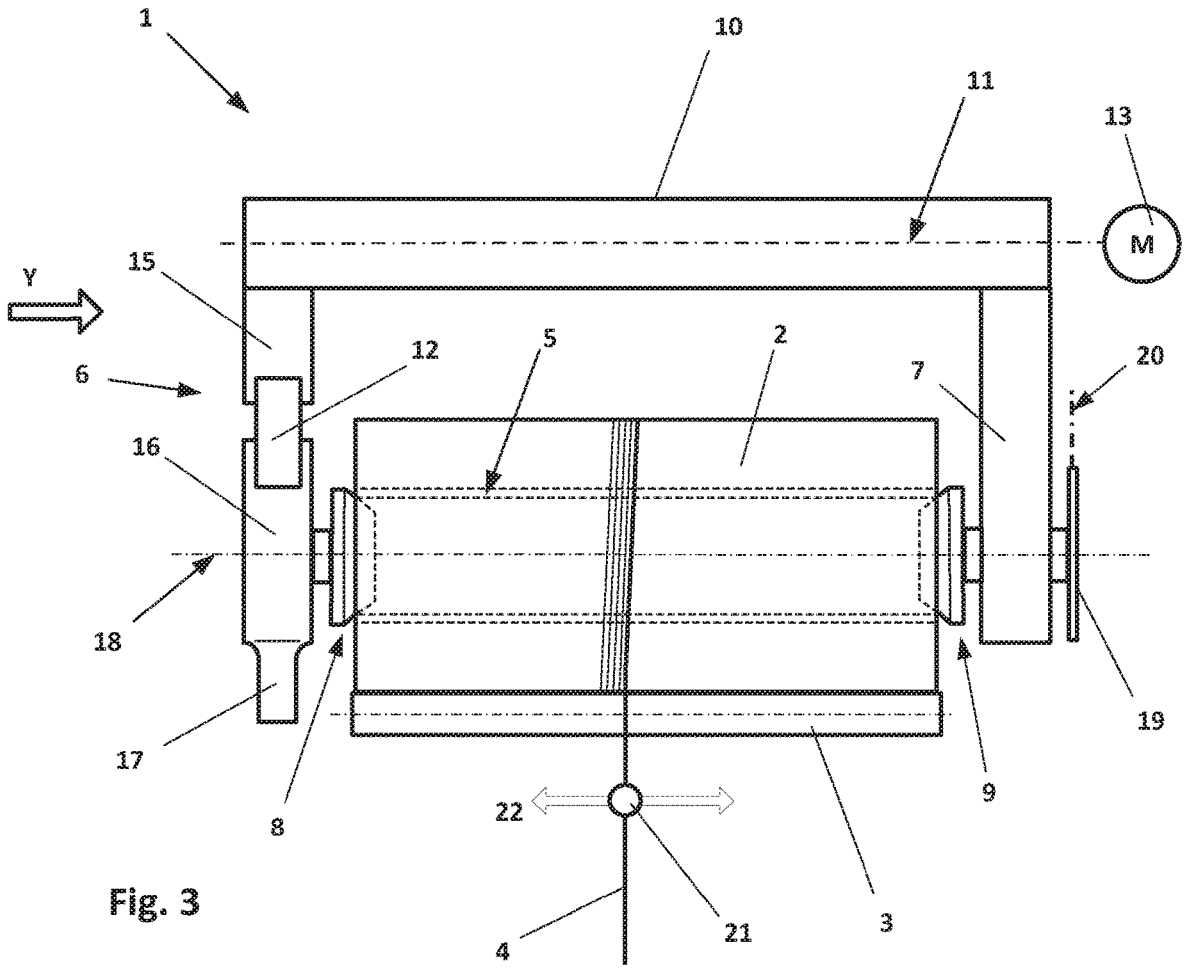
FIG. 3 shows a schematic illustration of a second embodiment of a winding device.
Figure 4:
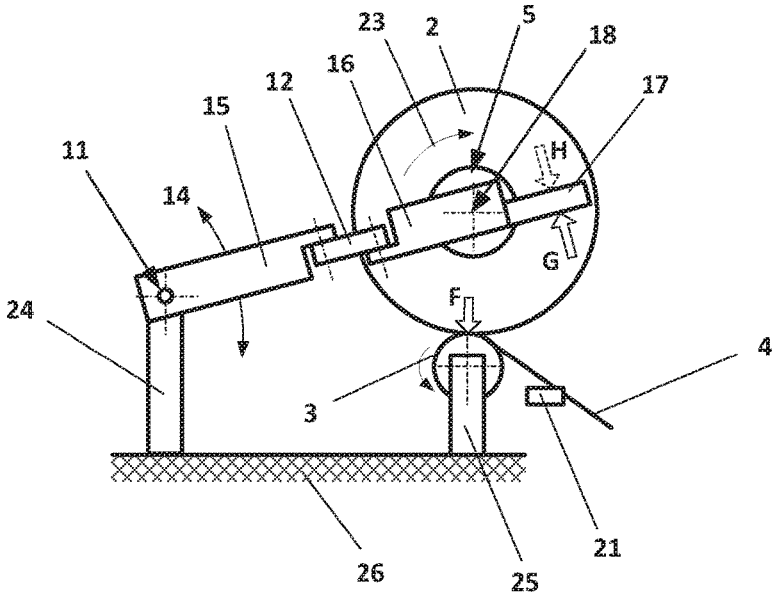
FIG. 4 shows a schematic side view of the winding device in direction Y according to FIG. 3.

FIG. 3 shows a schematic top view and FIG. 4 shows a schematic side view of a first embodiment of a winding device in direction Y in FIG. 3. The design of the device, with the exception of the force measurement unit 12, is identical to FIGS. 1 and 2, for which reason reference is made to the discussion for FIGS. 1 and 2 for a detailed description. In the embodiment shown, the force measurement unit 12 is integrated into the retaining arm 6. The retaining arm 6 has a two-part design. A first part 15 of the retaining arm 6 connects the swivel arm 10 to the force measurement unit 12, and a second part 16 of the retaining arm 6 leads from the force measurement unit 12, via the bobbin axis 18, to the defined location 17 for the manual transmission of force. The two parts 15 and 16 of the retaining arm 6 are screwed to the force measurement unit 12, the force measurement unit 12 being designed as a bending beam load cell.

The present invention is not limited to the represented and described exemplary embodiments. Modifications within the scope of the claims, as well as a combination of the features, even if they are represented and described in different exemplary embodiments, are an object of the invention.

LIST OF REFERENCE NUMERALS

1 bobbin frame
2 bobbin
3 backing roller
4 thread
5 bobbin tube
6 first retaining arm
7 second retaining arm
8 first holder
9 second holder
10 swivel arm
11 swivel axis
12 force measurement unit
13 drive
14 swivel motion
15 first part of the retaining arm
16 second part the retaining arm
17 defined location for the manual transmission of force
18 bobbin axis
19 drive wheel
20 drive element
21 traverse unit
22 movement direction of the traverse unit
23 rotational direction of the bobbin

24 stanchion
25 mounting for the backing roller
26 machine frame
F clamping force
G manual force directed away from the backing roller
H manual force directed toward the backing roller

The invention claimed is:

1. A method for swiveling a bobbin in a winding device during an interruption of a winding operation, wherein the bobbin rests on a backing roller and is formed on a bobbin tube onto which a thread is wound, the bobbin tube rotatably held between two retaining arms via a holder on each retaining arm, the two retaining arms mounted on a common swivel arm having a swivel axis, the method comprising:

with a force measurement unit, measuring one of intrinsic weight of the bobbin or a force effect that acts on the retaining arms due to contact of the bobbin with the backing roller;

manually transmitting a force into at least one of the retaining arms;

determining a force direction of the manually transmitted force by evaluating the force measurement unit; and with a drive operably configured with the swivel arm, swiveling the swivel arm in the force direction.

2. The method according to claim 1, wherein the swiveling of the swivel arm with the drive is continued for as long as the manually transmitted force is continued.

3. The method according to claim 1, further comprising using a controller associated with the drive to automatically bring the bobbin back into an operating position against the backing roller with a swivel motion of the swivel arm counter to the force direction.

4. The method according to claim 3, wherein the winding operation is continued when the bobbin rests on the backing roller.

5. A winding device for winding a thread onto a bobbin tube, comprising:

a swivel arm having a swivel axis;

opposite retaining arms non-rotatably mounted on the swivel arm and extending parallel to each other from the swivel arm;

each swivel arm comprising a rotatable holder for the bobbin tube at an end thereof opposite the swivel arm;

a drive associated with the swivel arm to swivel the swivel arm bout the swivel axis;

a force measurement unit disposed to measure a force that acts on the retaining arms;

a force transmission location defined on at least one of the retaining arms, wherein a manual force is transmitted to the retaining arm in a force direction at the force transmission location; and a controller configured to determine a direction of movement of the swivel arm about the swivel axis based on the force direction of the manual transmission of force.

6. The winding device according to claim 5, wherein one of the retaining arms comprises a two-part design, the force measurement unit connected between the two parts of the retaining arm.

7. The winding device according to claim 6, wherein the force measurement unit comprises a bending beam load cell.

8. The winding device according to claim 6, wherein the force transmission location comprises an extension of the two-part retaining arm.

9. The winding device according to claim 5, wherein the drive comprises an electric motor.

* * * * *